US005909833A

United States Patent [19]

Smith

[11] Patent Number: 5,909,833

[45] Date of Patent: Jun. 8, 1999

[54] UTILITY BAG FOR SPORTS GEAR

[76] Inventor: Samuel J. Smith, 3041 S. Michigan, #401, Chicago, Ill. 60616

[21] Appl. No.: 09/084,608

[22] Filed: May 26, 1998

[51] Int. Cl.[6] ..... B65D 30/06; B65D 30/10; B65D 33/06

[52] U.S. Cl. ..... 224/577; 224/601; 224/605; 224/613; 224/614; 224/919; 383/4; 383/67; 473/485

[58] Field of Search ..... 383/117, 13, 67, 383/4; 224/577, 601, 605, 613, 612, 614, 919; 473/485–489; 206/315.3–315.8, 315.9

[56] References Cited

U.S. PATENT DOCUMENTS

| | | | |
|---|---|---|---|
| 1,737,065 | 11/1929 | Thornton | 383/117 |
| 2,510,186 | 6/1950 | Marsico et al. | 383/117 |
| 2,552,443 | 5/1951 | Molinari | 383/117 |
| 2,617,569 | 11/1952 | Sommer | 383/117 |
| 2,682,290 | 6/1954 | Ditlea | 383/117 |
| 3,322,176 | 5/1967 | Geller | 383/117 |
| 3,483,907 | 12/1969 | Corridon | 383/117 |
| 4,903,964 | 2/1990 | Anderson | 273/1.5 R |
| 5,098,108 | 3/1992 | McKinney | 273/400 |
| 5,150,970 | 9/1992 | Albarelli | 383/117 |
| 5,338,023 | 8/1994 | Stovall | 273/15 R |

*Primary Examiner*—Stephen P. Garbe

[57] ABSTRACT

A utility bag for carrying and storing sports gear. The bag has a hollow cylindrical body portion, a removable bottom portion for closing the bottom of the body, and a removable shoulder strap. The body portion is made of basketball netting with loops along the top edge for installation and use on a basketball goal rim. Attachments for sports related items are provided on the strap and on the body portion, and a purse is attached to the bottom portion.

13 Claims, 2 Drawing Sheets

UTILITY BAG FOR SPORTS GEAR

FIELD OF THE INVENTION

The present invention relates generally to carrying devices, and more particularly, to bags and other containers for storing and carrying sports equipment, apparel, and accessories.

BRIEF DESCRIPTION OF THE PRIOR ART

Sports activities usually require special equipment and apparel necessary to participate in the activity. Such special sports gear may include a particular type of ball, shoes, and clothing. Also, many outdoor basketball courts do not have nets on the rims, so basketball nets must be carried along to the court as well. These items can be cumbersome to carry to the sports venue, especially when walking, riding a bicycle, or riding a crowded train or bus.

A common carrying device for sports gear is a conventional gym bag, but gym bags are often too small to include a basketball. Other known carrying devices include U.S. Pat. No. 4,693,402 and to Comeau and U.S. Pat. No. 5,174,481 to LeDune. Both of these patents disclose carrying devices specifically adapted for use with baseball equipment, and neither can fit a basketball. U.S. Pat. No. 5,615,769 to Stephenson provides a sports ball bag, but is specifically adapted for use with a football, which is smaller and elongated relative to a round basketball. Other carrying bags which could be adapted for use with sports gear include U.S. Pat. No. 2,552,443 to Molinari and U.S. Pat. No. 2,617,569 to Sommer. Neither of these devices, nor any of the above discussed, are adaptable for use as a basketball net which can be installed onto a basketball rim. U.S. Pat. No. 5,484,144 to St. Onge and U.S. Pat. No. 4,834,368 to Qualley disclose portable basketball net assemblies, but neither of these is adaptable for use as a sports gear carrying bag.

SUMMARY OF THE INVENTION

In accordance with the present invention, there is provided a utility bag for storing and carrying sports gear, which is adaptable for use as a basketball net installed on the rim of a basketball goal. The bag is suitable for carrying all gear necessary for sports participation in one container, including items such as basketballs, basketball shoes, sweat shirts and pants, towels, water bottles, caps, eyeglasses, whistles, keys, identification cards, and money.

The invention has a generally cylindrical hollow body with an open top and bottom. A bottom portion is removably connected to the body portion for closing the bottom of the body. A shoulder strap is provided with removable connectors fastened to the body and bottom portions, for ease of carrying. The body portion and the strap have clamps for attaching items such as the water bottles, caps, and eyeglasses. The bottom portion has a purse for holding an identification card and money.

The generally cylindrical body is made of a basketball net and has twelve hoops at the top end for attaching to a conventional basketball rim. The generally cylindrical hollow body can thus be installed on the rim of a basketball goal and used as a conventional basketball net when not in use for carrying or storing sports equipment.

These and other features of the present invention are discussed or apparent in the following detailed description.

BRIEF DESCRIPTION OF THE DRAWINGS

The various features and advantages of the invention will be apparent from the attached drawings, in which.

DETAILED DESCRIPTION OF THE PREFERRED EMBODIMENT

Figure 1:
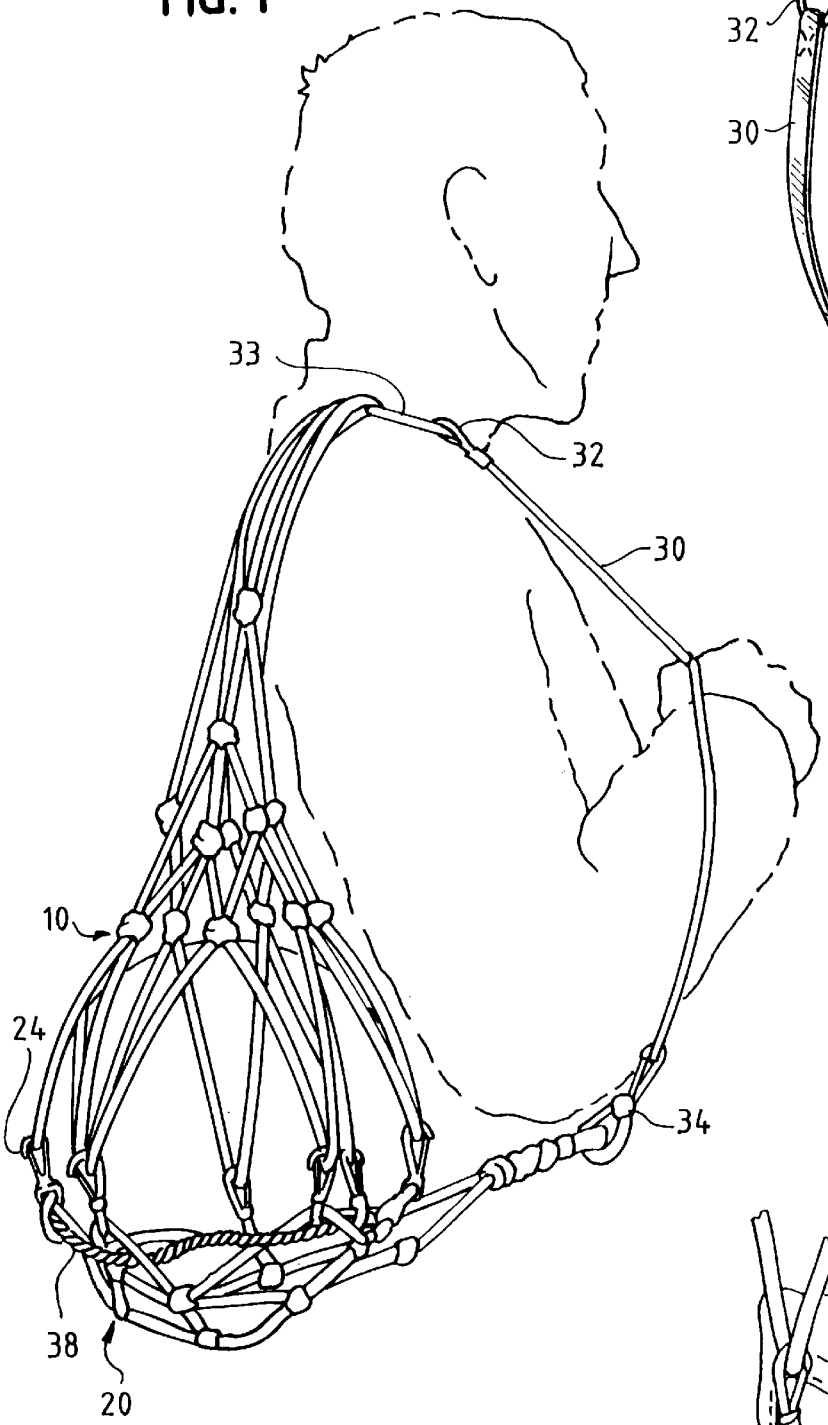
FIG. 1 is a perspective view of the preferred embodiment showing the bag used for holding a basketball.
Figure 2:
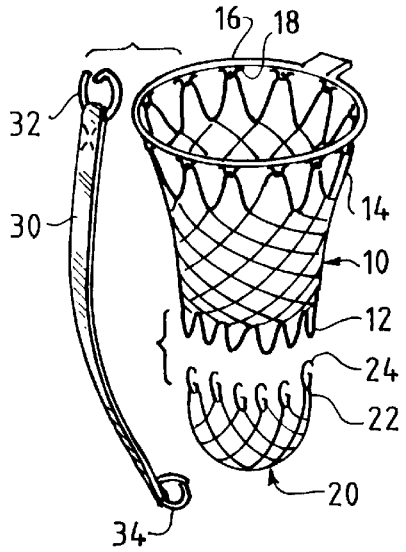
FIG. 2 is a perspective view showing the bottom portion and strap detached from the body, which is installed on a basketball rim.

Referring now to FIG. 1, there is illustrated a preferred embodiment of the present invention showing the bag housing a basketball with other sports related gear attached to the bag. As shown in FIG. 2, a generally cylindrical hollow body (10) is provided with open bottom and top ends having bottom loops (12) and top loops (14). In the preferred embodiment, the body (10) is made of nonrigid netting of the type commonly used for basketball nets. The body (10) is also of a similar size, diameter and length, to typical basketball nets, so a basketball, football, soccer ball, or the like can easily fit within the cylindrical body.

A bottom portion (20) is provided for closing the bottom end of the body (10). The bottom portion (20) is generally circular in shape, with an outer edge having loops (22) alignable with the bottom loops (12) of the open bottom end of the body (10). While the bottom portion (20) is generally circular, it may be substantially flat or generally cup shaped. Removable connectors (24), such as hook clamps, are provided for connecting the bottom portion loops (22) to the body portion bottom loops (12). The bottom portion (20) can be made of nonrigid netting of the type commonly used for basketball nets, or of any other material that is generally lightweight, durable, and strong.

Figure 5:
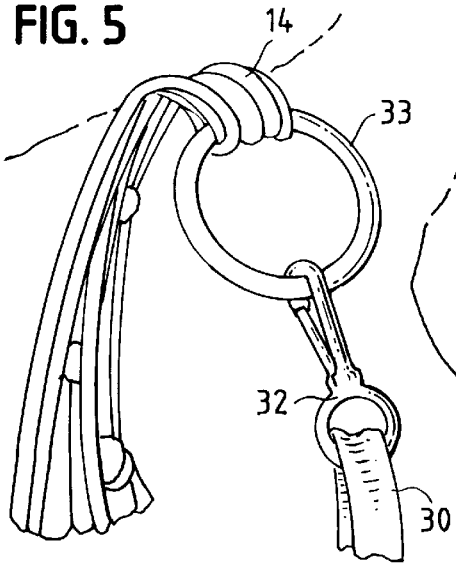
FIG. 5 is a detail view showing a ring on one strap end for holding a towel.

A shoulder strap (30) is provided for ease of carrying. The strap (30) has removable connectors (32, 34), such as hook clamps, at each end for connecting the strap ends to the body and bottom portion. One strap connector (32) receives the top loops (12) of the body portion (10), thereby also closing the open top of the body to hold a ball or other items inside the bag. The other strap connector (34) can be attached to a bottom portion loop (22), directly to the bottom portion netting, or to a drawstring (38) threaded through the bottom portion. As shown in FIG. 5, a removable ring (33) can be provided at the body portion end of the strap (30) for holding a towel and for providing greater ease of collecting and securing to the top loops (12). The strap (30), body (10),and bottom (20), are all made of a nonrigid material for compacting for storage in a small space when the bag is not in use.

Figure 3:
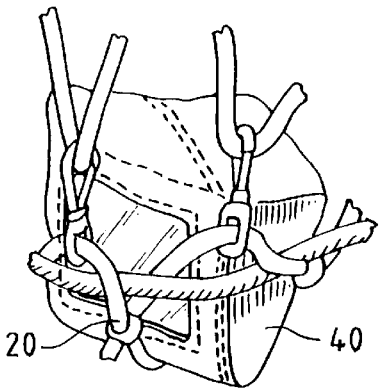
FIG. 3 is a detail view showing the purse attached to the bottom portion.
Figure 4:
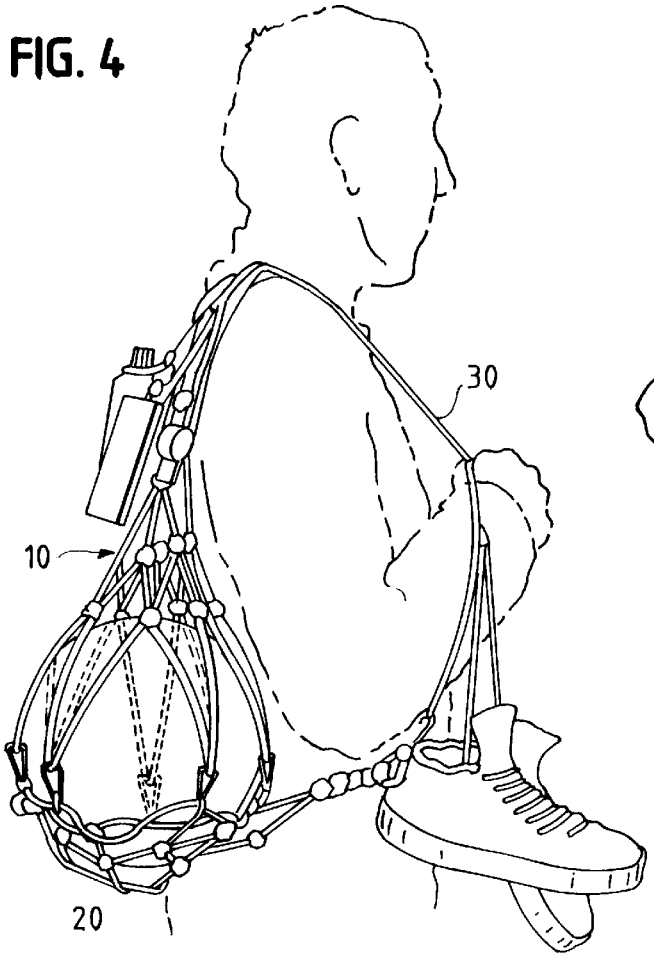
FIG. 4 is a perspective view of an embodiment showing the bag used for holding a basketball and with sports gear attached thereto.
Figure 6:
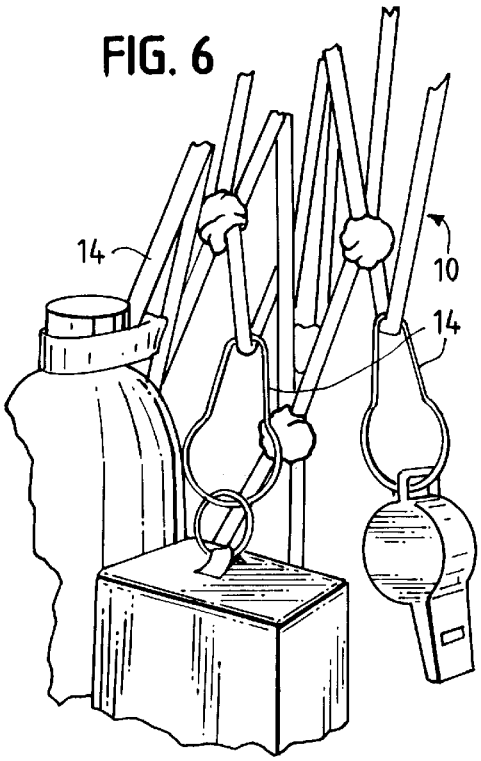
FIG. 6 is a detail view showing a water bottle, whistle, and eyeglass case attached to the body portion.
Figure 7:
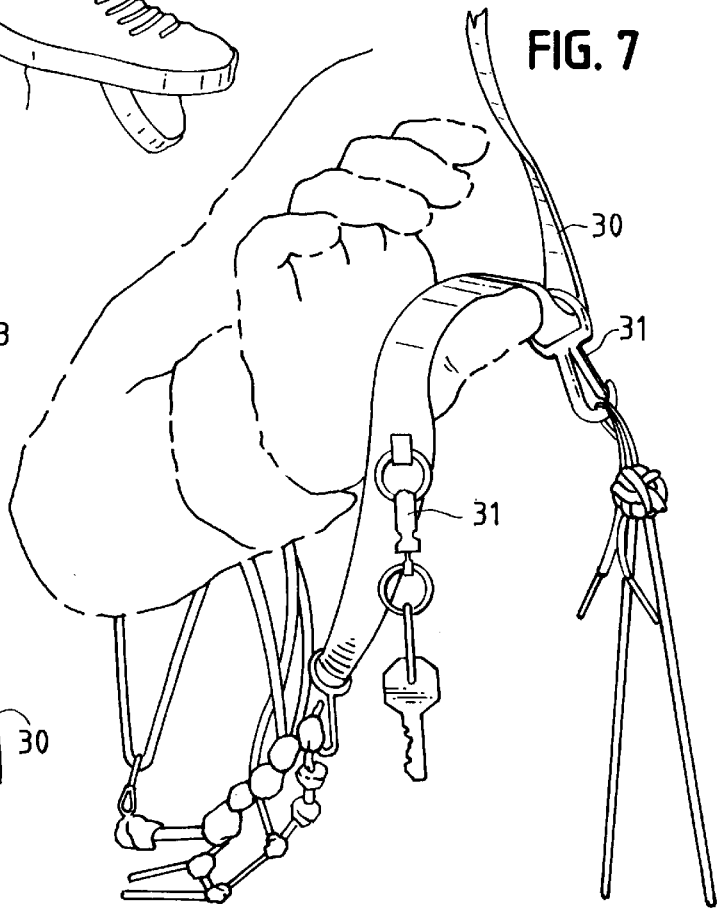
FIG. 7 is a detail view showing keys and shoes attached to the strap.

As shown in FIG. 4, the bag is adapted for carrying a number of accessories. As shown in FIG. 3, there is provided a purse (40) for identification, club membership, and pass cards, for transportation tokens, coins and paper money, and any other small valuables. The purse (40) is removably attached, by VELCRO strips or other similar means, to the inside of the bottom portion (20) so it is not easily accessible without gaining the attention of the wearer of the bag. As shown in FIG. 6, the body (10) is provided with attachments (14) for water bottles, eyeglass cases, whistles, and the like. As shown in FIG. 7, the strap (30) is provided with clamps (31) for attaching basketball shoes, keys, and the like.

Referring back to FIG. 2, the top loops (12) of the body (10) are adapted to receive the hooks (18) on a typical basketball goal rim (16). In the preferred embodiment, twelve loops (12) are provided and the body (10) is of comparable diameter to the rim (16). The generally cylindrical hollow body (10) can thus be installed on the rim of a basketball goal and used as a conventional basketball net when the bottom portion (20) and the strap (30) are detached.

It will be appreciated that this application covers all such embodiments and modifications that fall within the true scope and spirit of the claims provided hereinafter.

What is claimed is:

1. A utility bag for sports gear comprising a generally cylindrical hollow body portion formed by a continuous wall and having an open top end with loops and an open bottom end with loops, a bottom portion having connector means for removably connecting said bottom portion to said bottom end loops of said body portion for closing said body portion bottom end, and a shoulder strap having connector means at each end for removably connecting one strap end to said body portion and the other strap end to said bottom portion.

2. A utility bag for sports gear in accordance with claim 1 having twelve top end loops for removably connecting said open top end of said body portion to a basketball rim.

3. A utility bag for sports gear in accordance with claim 1 in which said body portion is made of nonrigid netting.

4. A utility bag for sports gear comprising a generally cylindrical hollow body portion formed by a continuous wall and having an open top end and an open bottom end, a bottom portion having connector means for removably connecting said bottom portion to said body portion for closing said body portion bottom end, and a shoulder strap having connector means at each end for removably connecting one strap end to said body portion and the other strap end to said bottom portion.

5. A utility bag for sports gear in accordance with claim 4 having loops for removably connecting said open top end of said body portion to a basketball rim.

6. A utility bag for sports gear in accordance with claim 5 having twelve loops.

7. A utility bag for sports gear in accordance with claim 4 in which said body portion is made of nonrigid netting.

8. A utility bag for sports gear in accordance with claim 4 in which said bottom portion is generally circular and made of nonrigid netting.

9. A utility bag for sports gear in accordance with claim 4 having a purse removably attached to said bottom portion, for holding an identification card, coins, bills, and the like.

10. A utility bag for sports gear in accordance with claim 4 in which said strap end connector means comprise hook clamps and a ring for holding a towel.

11. A utility bag for sports gear in accordance with claim 4 in which said bottom portion includes a drawstring for connecting said strap end connector means to said bottom portion.

12. A utility bag for sports gear in accordance with claim 4 having attachment means on said strap for removably attaching keys, shoes and the like to said strap.

13. A utility bag for sports gear in accordance with claim 4 having attachment means on said body portion for removably attaching a water bottle, eyeglass case, whistle, cap, gloves or mittens, and the like to said body portion.

* * * * *